US007489318B1

(12) United States Patent
Wilt

(10) Patent No.: US 7,489,318 B1
(45) Date of Patent: Feb. 10, 2009

(54) APPARATUS AND METHOD FOR MANAGING MEMORY TO GENERATE A TEXTURE FROM A RENDER TARGET WHEN FORMING GRAPHICAL IMAGES

(75) Inventor: Nicholas Patrick Wilt, Rochester, NY (US)

(73) Assignee: NVIDIA Corporation, Santa Clara, CA (US)

( * ) Notice: Subject to any disclaimer, the term of this patent is extended or adjusted under 35 U.S.C. 154(b) by 69 days.

(21) Appl. No.: 10/851,555

(22) Filed: May 20, 2004

(51) Int. Cl.
*G09G 5/00* (2006.01)

(52) U.S. Cl. ..... 345/582; 345/506; 345/537; 345/539; 345/554; 345/672; 345/674; 711/149; 711/150; 711/162

(58) Field of Classification Search ..... 345/588, 345/674
See application file for complete search history.

(56) References Cited

U.S. PATENT DOCUMENTS

| | | | | |
|---|---|---|---|---|
| 6,201,547 | B1 * | 3/2001 | Rogers et al. | 345/582 |
| 6,883,074 | B2 * | 4/2005 | Lee et al. | 711/162 |
| 6,911,983 | B2 * | 6/2005 | Sabella et al. | 345/536 |
| 7,034,841 | B1 * | 4/2006 | Weiblen et al. | 345/582 |
| 7,091,979 | B1 * | 8/2006 | Donovan | 345/530 |
| 7,328,316 | B2 * | 2/2008 | Moir et al. | 711/150 |
| 2004/0179019 | A1 * | 9/2004 | Sabella et al. | 345/537 |

* cited by examiner

*Primary Examiner*—Antonio A Caschera
(74) *Attorney, Agent, or Firm*—Cooley Godward Kronish LLP

(57) ABSTRACT

An exemplary method detects an update to data representing a portion of a render target, according to one embodiment of the invention. Also, this method forms a copy of the portion configured to be overwritten with data for a subsequent update when that portion of the render target is selected to receive subsequent updates. Lastly, the data representing the portion can be designated as texture.

10 Claims, 9 Drawing Sheets

2 banks of 4 tiles

Legend empty

RT

Texture

RT+texture

1. P=0000
   D=1111
2. RT tiles: P[i]^D[i]==1111
   T tiles: Not yet valid; only valid after first snapshot First snapshot:
P[i]=P[i]^D[i]
D[i]=0

P=1111
D=0000

RT tiles: P[i]^D[i]==1111
T tiles: P[i]==1111

Rendering to tile[0]:
1. D[0]==0
2. so copy Bank[1][0] to Bank[0][0]
3. set D[0]=1

1. P=1111
   D=1000
2. RT banks: P[i]^D[i]==0111
   T banks: P[i]==1111
3. Note: No copy occurs for subsequent rendering to tile[0], since D[0]=1

Second snapshot
1. P[i]=P[i]^D[i], D[i]=0, for all i
2. P=0111
   D=0000
3. RT tiles: P[i]^D[i]==0111
   T tiles: P[i]==0111

Render to tiles 1,2
1. Copy RT from bank 1->bank 0
2. Set D[1], D[2]
3. P=0111
   D=0110
4. RT tiles: P[i]^D[i]==0001
   T tiles: P[i]==0111

Render to bank 0
1. Copy RT from bank0->bank1
2. Set D[0]
3. P=0111
   D=1110
4. RT tiles: P[i]^D[i]==1001
   T tiles: P[i]==0111

Third snapshot
1. P[i]=P[i]^D[i], D[i]=0,
   for all i
2. P=1001
   D=0000
3. RT tiles: P[i]^D[i]==1001
   T tiles: P[i]==1001

APPARATUS AND METHOD FOR MANAGING MEMORY TO GENERATE A TEXTURE FROM A RENDER TARGET WHEN FORMING GRAPHICAL IMAGES

CROSS-REFERENCE(S) TO RELATED APPLICATIONS

The present disclosure is related to co-pending U.S. patent application Ser. No. 10/388,112, filed Mar. 12, 2003, and titled "Double-Buffering of Pixel Data using Copy-on-Write Semantics," which is incorporated by reference in its entirety for all purposes.

BRIEF DESCRIPTION OF THE INVENTION

This invention relates generally to generating graphical images, and more particularly, this invention relates to managing memory to use graphical images as input for effectuating graphics processing. As an example, a memory includes a render target and a copy of that render target for use as texture, whereby the copy is formed and updated in an efficient manner.

BACKGROUND OF THE INVENTION

To hasten the generation and display of increasingly complex computer-generated imagery, conventional graphics processing techniques include recursively rendering and combining previously generated images, whereby a single, highly detailed graphic image is formed. An algorithm implementing such a technique is referred to as a multiple pass ("multipass") algorithm. To illustrate, consider a graphical processor unit ("GPU") executing instructions of a video game application, those instructions including a multipass algorithm. In this example, the multipass algorithm renders and then stores an image of a computer-generated scene. Next, the multipass algorithm uses the stored scene as an input to render the scene in combination with another graphical image, such as with one or more characters. Thereafter, the image of the scene with the characters is available as an input for further rendering, where each additional pass adds other like graphical images, such as weaponry, special effects (e.g., muzzle flashes), etc., to the scene.

FIG. 1 is a block diagram of a traditional system for generating graphical images whereby a render target is used as both as a repository for finally generated images as well as a source of images used as texture for further rendering, for example, in subsequent passes of multipass rendering. System 100 includes a GPU 102 containing a shader 104, which operates to alter properties (e.g., lighting, transparency, color, texture, etc.), position, and orientation for surfaces of rendered objects. Shader 104 is typically a vertex shader, a pixel shader, or the like, and comprises any number of pixel pipelines 108. As shown in FIG. 1, shader 104 includes four pixel pipelines 108 for processing pixel data. To process the pixel data, shader 104 receives one or more textures 106, such as textures 106*a*, 106*b*, and 106*n*, for incorporating texture data into the pixel data. Filter 110 (e.g., an anisotropic filter), if employed, filters textures 106 to improve image quality when rendering three-dimensional ("3-D") scenes. Textures 106 are static texture maps for application onto surfaces of 3D graphical objects, examples of which include surface appearances of walls, floors, ceilings, doors, and other structures where the textures do not change or otherwise animate.

Each of pixel pipelines 108 continues from shader 104 and extends to a render target 122 residing in graphics memory 120, which can be implemented as a frame buffer. Conventionally, render target 122 is an intermediary storage that is accessible as both as a target and a source of image data. That is, it is a target to which image data is written so computer-images can be displayed, and it is a source for providing a texture as input back into shader 104. By recursively writing to render target 122 and reading a texture from that render target, multiple passes can integrate complex visual effects into images of previous rendering passes.

But there are several drawbacks to the approach of using render target 122 as texture as input to further render graphical images. For example, synchronicity of multiple writes 130 to and reads 132 from render target 122 is computationally expensive, among other things, when managing those writes 130 and reads 132 in parallel, or during any overlapping interval of time. Since render target 122 is a shared resource (i.e., memory), writes 130 and reads 132 with respect to each pixel stored in render target 122 must be managed at a fine-grained level. That is, every memory location storing pixel data from each pipeline 108 is managed to prevent overlapping write and read operations from interfering with each other and corrupting the pixel data. Without properly ordering these operations, conflicting write and read operations would result in incorrect pixel data. And if GPU 102 implements multiple threads or an increased number of shaders 104, the amount of computations and/or hardware to synchronize the increased numbers of writes 130 and reads 132 becomes expensive. Further to this approach, latency is introduced into the multipass rendering of graphical images, especially when system 100 performs synchronization at fine-grained levels, such as when memory locations are "locked-out" (i.e., blocked against programming or otherwise altering). While any access to or from the render target is prohibited or locked-out, one or more pixel pipelines stall until such access is granted. This delays graphical image generation and thus hinders performance. These delays are relatively long because pixel pipelines 108 between render target 122 and 108 include numerous intermediary graphics subprocesses, such as depth testing, compositing, blending, etc.

In view of the foregoing, it would be desirable to provide an apparatus and a method for efficiently employing a render target as a texture. Ideally, an exemplary method would minimize or eliminate at least the above-described drawbacks.

SUMMARY OF THE INVENTION

An apparatus, system, method, and computer readable medium is disclosed for generating graphical images. In one embodiment, an exemplary method comprises detecting an update to data representing a portion of a render target, and forming a copy of the portion configured to be overwritten with data for a subsequent update to the portion of the render target, where data representing the portion is designated as texture. According to an alternative embodiment, this method further comprises designating the copy as texture rather than the portion.

In another embodiment of the present invention, an exemplary method for managing image data constituting a computer-generated image is provided. This method comprises establishing a first and a second tile association for each of a plurality of tiles, each of said first tile associations indicating which of two memory banks stores image data representing a portion of a render target, each of said second tile associations indicating which of said two memory banks stores image data representing a portion of texture, selecting one of the plurality of tiles for storing data representing a portion of an updated render target; and modifying a first tile association of said one of said plurality of tiles from one to another of the two memory banks.

BRIEF DESCRIPTION OF THE FIGURES

The invention is more fully appreciated in connection with the following detailed description taken in conjunction with the accompanying drawings, in which.

Like reference numerals refer to corresponding parts throughout the several views of the drawings.

DETAILED DESCRIPTION OF THE INVENTION

Figure 1:
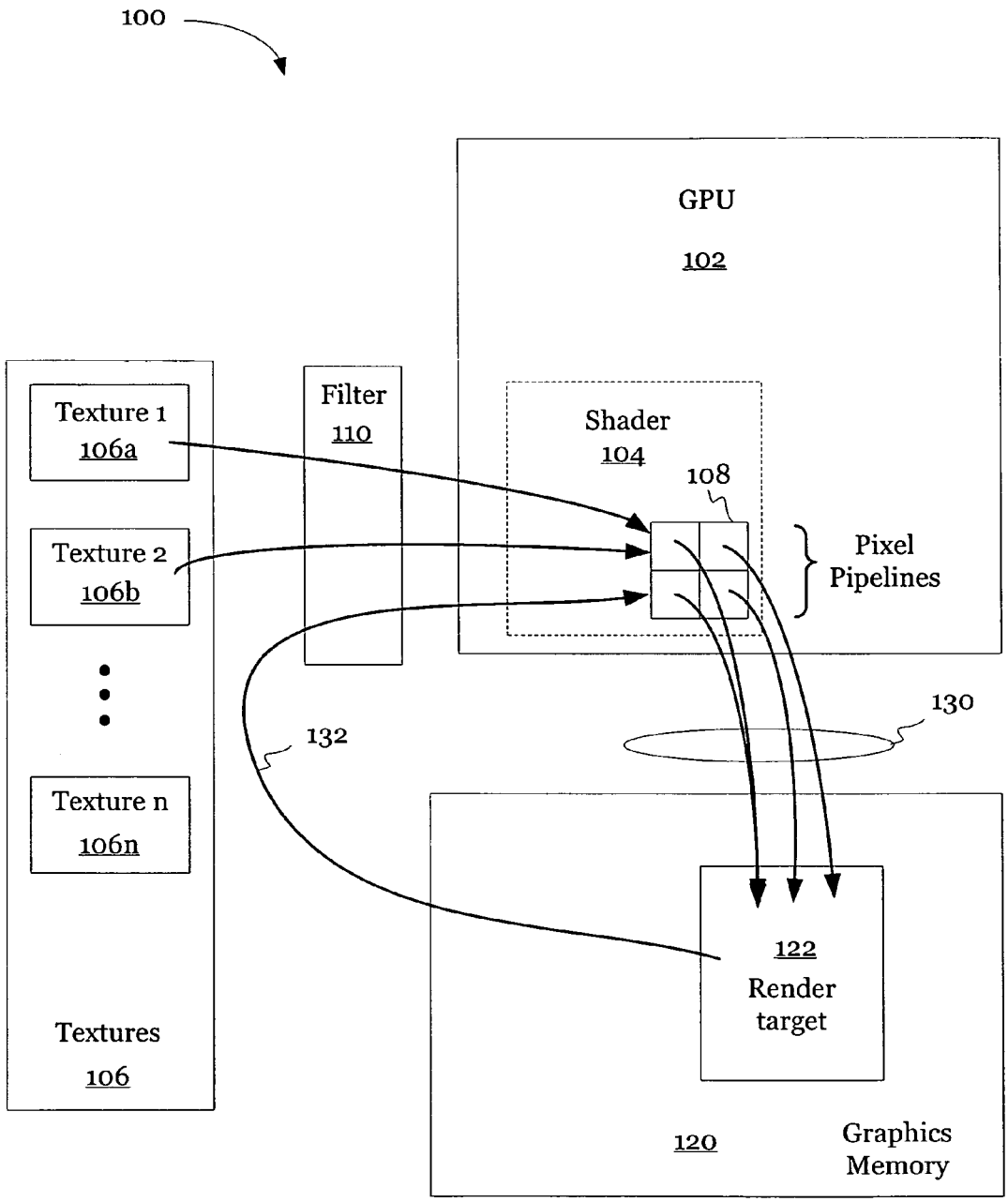
FIG. 1 (Prior Art)
FIG. 1 is a block diagram of a traditional system for generating graphical images whereby a render target is used as both as a repository for finally generated images as well as a source of images used as texture for further rendering.
Figure 2:
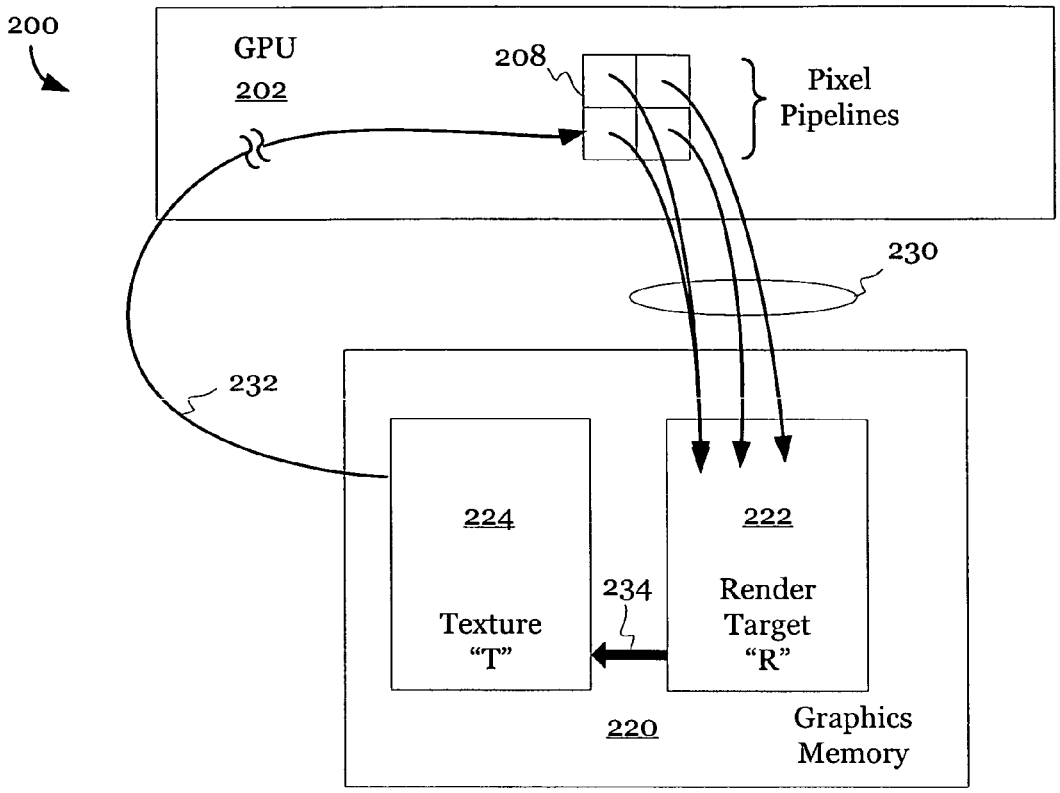
FIG. 2 is a functional block diagram illustrating an exemplary system for facilitating the use of a render target as texture in accordance with an embodiment of the present invention.

FIG. 2 is a block diagram illustrating an exemplary system 200 for facilitating the use of a render target as texture in accordance with an embodiment of the present invention. System 200 includes a graphics-generating processor, such as GPU 202, coupled to a graphics memory 220. Conceptually, graphics memory 220 includes memory designated as a render target ("R") 222 and as a texture ("T") 224, whereby CPU 202 or any number of pixel pipelines 208 are configured to write render targets to render target 222 and read textures from texture 224. In system 200, CPU 202 can perform write operations 230 and read operations 232 in parallel without those operations conflicting with each other. System 200 stores image data that is written to render target 222 in memory that is separable from image data constituting the texture. As such, write operations to the render target can avoid conflicting with read operations from texture. Because each is managed as separate entities (and not as a shared memory), the need to synchronize write and read accesses with memory, such as during multipass rendering, is obviated. Similarly, writes 230 and reads 232 need not be ordered in their accesses to render target 222 and as texture 224, respectively, which can be the case with one or more execution threads.

System 200 generally also can ameliorate latency inherent in schemes that share memory to implement a render target as texture. With render target 222 being a write-only memory, GPU 202 can render image data to render target 222 without invoking a "lock-out" for any write access when a read access of texture 224 is pending, unlike some structures using shared memory as both render target and texture. For these reasons, and those that follow, a graphical image generation process in accordance with the present invention enhances GPU performance by, for example, freeing up graphics processing that otherwise is dedicated to managing memory when a shared memory is used as both render target and texture. Although this discussion describes a system that operates in conjunction with GPU 202, one ordinarily skilled in the art should appreciate that any central processor unit ("CPU")-based graphics generation device (single or multiple CPUs), as well as any other kinds of graphics generation devices, is within the scope and the spirit of the present invention.

Each of render target 222 and texture 224 can be implemented as a two-dimensional array of tiles, with each array having a number of "N" tiles. A tile represents a grouping of one or more units of image data, such as one or more pixels, texels (i.e., texture elements), or any other kind of data for generating graphical imagery. With other such tiles, the tiles either constitute a displayable computer-generated scene (e.g., on display monitor, such as a liquid crystal display) if in render target 222, or constitute a texture for further graphics processing if in texture 224. In operation, render target 222 is available for receiving image data from a source, such as GPU 202, when that data is rendered to graphics memory 220. So, render target 222 generally contains data representing graphical images as that data is generated. By contrast, once the image data from render target 222 is copied into texture 224, then that image data can be available as texture during discrete intervals of time.

As an example, consider that texture 224 is a copy of render target 222 formed, at least in part, when an application (not shown), such as a software program that generates graphical images, instructs the GPU 202, such as by way of a "snapshot" command, to use render target 222 as texture during a pass of a multipass algorithm. A snapshot command causes image data in render target 222 to copy 234 over into texture 224 to form a "snapshot" of the render target so that it can be used as texture. According to one embodiment, a "snapshot" operation designates image data of a render target (or a portion thereof) as image data that also can represent a texture (or a portion thereof). As a result, a unit of render target image can occupy the same memory location containing a unit of texture image data. Typically after a snapshot is performed, the texture remains as a previously rendered graphical image (until the next snapshot) while the render target is available for receiving image data that can be written (i.e., updated) in real or near real time.

Further, consider that a previous pass of a multipass algorithm renders a graphical image of a character (as in a video game) onto a graphical image of a scene, such as a wall, and stores the combined graphical image into render target 222. To render a special effect (e.g., lens flare, distortion, etc.) into that combined graphical image, GPU 202 performs a snapshot of render target 222 so that image data can be used as a texture. Specifically, GPU 202 copies 234 the contents of render target 222 into texture 224 in response to the snapshot command. Texture 224 provides an input as texture in discrete states until the next snapshot command again updates the image data of texture 224. Although a snapshot command can be implemented in a variety of ways and circumstances, a snapshot command can be coded into an application so that it is positioned for execution between one or more passes of a multipass algorithm. As a result, the render target is available as an updated texture for each pass of the algorithm.

According to the present invention, GPU 202 can perform snapshots on a coarse-grained level rather than at a fine-grained level, thus freeing up processing resources that otherwise would be devoted to managing the physical copying of a render target to texture on a pixel-by-pixel basis. According to an embodiment of the present invention, render target 222 is copied into texture 224 on a tile-by-tile basis (or a quad-by-quad basis), where a tile can include any number of pixels. As such, GPU 202 need only manage the copying of pixels as a collection rather than treating them as individuals. The computational overhead of copying of the tiles from render target 222 into texture 224 is further decreased by managing the copying of tiles by modifying pointers indicating whether a tile belongs to either render target 222 or texture 224, according to another embodiment of the present invention. Modifying pointers enable both the reading of texture from and the writing of image data to a tile by just changing the memory to which the pointers indicate. By editing bit vectors containing those pointers, there is less processing overhead necessary for copying select tiles of render target into texture in comparison with, for example, the "naïve," or "blind," copying of the entire render target into texture. Some exemplary embodiments employing pointer-based copying are described below.

According to a specific embodiment of the present invention, a snapshot of render target 222, as texture, includes image data that has been selected to be written into render target 222 before the assertion of the snapshot command. In particular, a pending write 230 that is in pipelines 208 when a specific snapshot has been asserted can be included in the snapshot. So, during such a snapshot, image data in pipelines 208 can be copied 234 at the same time as the image data residing in render target, or can be copied 234 either at any time thereafter. Consequently, if a surface (of a computer-generated 3-D object) is selected as both render target and texture, then writes 230 bound for render target 222 can also be copied 234 over into texture 224 as part of the snapshot.

Figure 3:
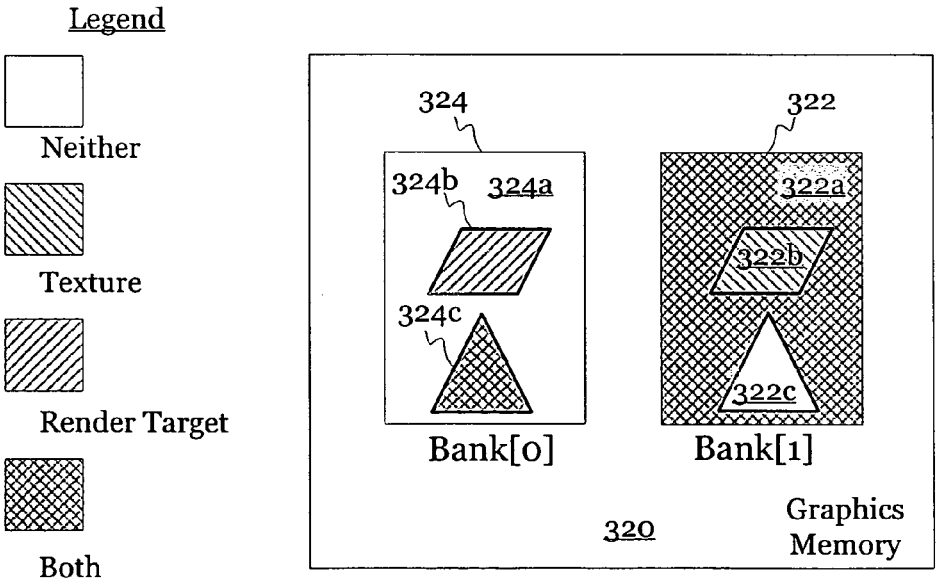
FIG. 3 illustrates a memory used to facilitate the use of a render target as texture in accordance with a specific embodiment of the present invention.

FIG. 3 illustrates an exemplary graphics memory 320 for facilitating the use of a render target as texture in accordance with a specific embodiment of the present invention. As shown, a graphics memory 320 includes memory designated as a first bank ("Bank[0]") 324 and as a second bank ("Bank [1]") 322, both of which are used to implement a render target as texture. In this example, each tile in any of banks 322 and 324 can include image data as either texture or render target, or both. In some cases, a tile can include neither texture nor render target. So at any time during a process of using a render target as texture, either bank can include any combination of texture or render target. Further to this embodiment, a texture is formed from the render target in two phases: (1) incrementally, when GPU 202 renders image data into individual tiles of render target 322, and (2) completely, when GPU 202 performs a snapshot command.

First, the texture is incrementally formed when GPU 202 writes to one or more tiles of a render target. If these tiles have yet to been written to since first being rendered, then a copy of what is selected to be written into these tiles are instead written into another bank (rather than the bank presently containing the render target). Typically, these tiles would not be available immediately available as texture, but would be available after a snapshot. During such a snapshot, the tiles that were not written in the render target would not need to be copied as part of the texture, thus preserving computational resources. Second, a snapshot command designates tiles that were already incrementally copied (during subsequent writes to the render target) as texture after the snapshot is performed. Accordingly, texture relating to other tiles that were not part of the first phase will not need to be copied, again preserving computational resources.

FIG. 3 illustrates the implementation of these two phases. First consider that bank 322 is initialized as the render target (not shown), such that all of its tiles are designated as render target. Until any image data is rendered to bank 322, this bank can also serve as texture (after a snapshot), as is shown in crosshatch shading. Bank 324 is not yet active in the render-target-to-texture process. Next, consider that image data (e.g., multiple tiles) are being written into bank 322. As a phase one copy, this image data is written into Bank[0] as image data 324*b* rather than being written into bank 322 as 322*b*, with image data 324*b* identified as texture. Lastly, consider that image data 322*c* was previously written to Bank[1] (not shown), which results in image data 324*c* being written as render target (not shown). Then, a snapshot causes texture of that image data to be reset as the same image data 324*c*. Afterwards, tiles associated with image data 322*c* and 324*a* contain neither texture or render target, whereas tiles 322*a* remains designated as both. This example demonstrates that in various embodiments of the present invention, minimal "copying" is performed so as to minimize the use of computational resources. According to a specific embodiment, the tiles of this example are not physically copied, but rather are associated with different banks 322 and 324 by way of pointers.

Figure 4:
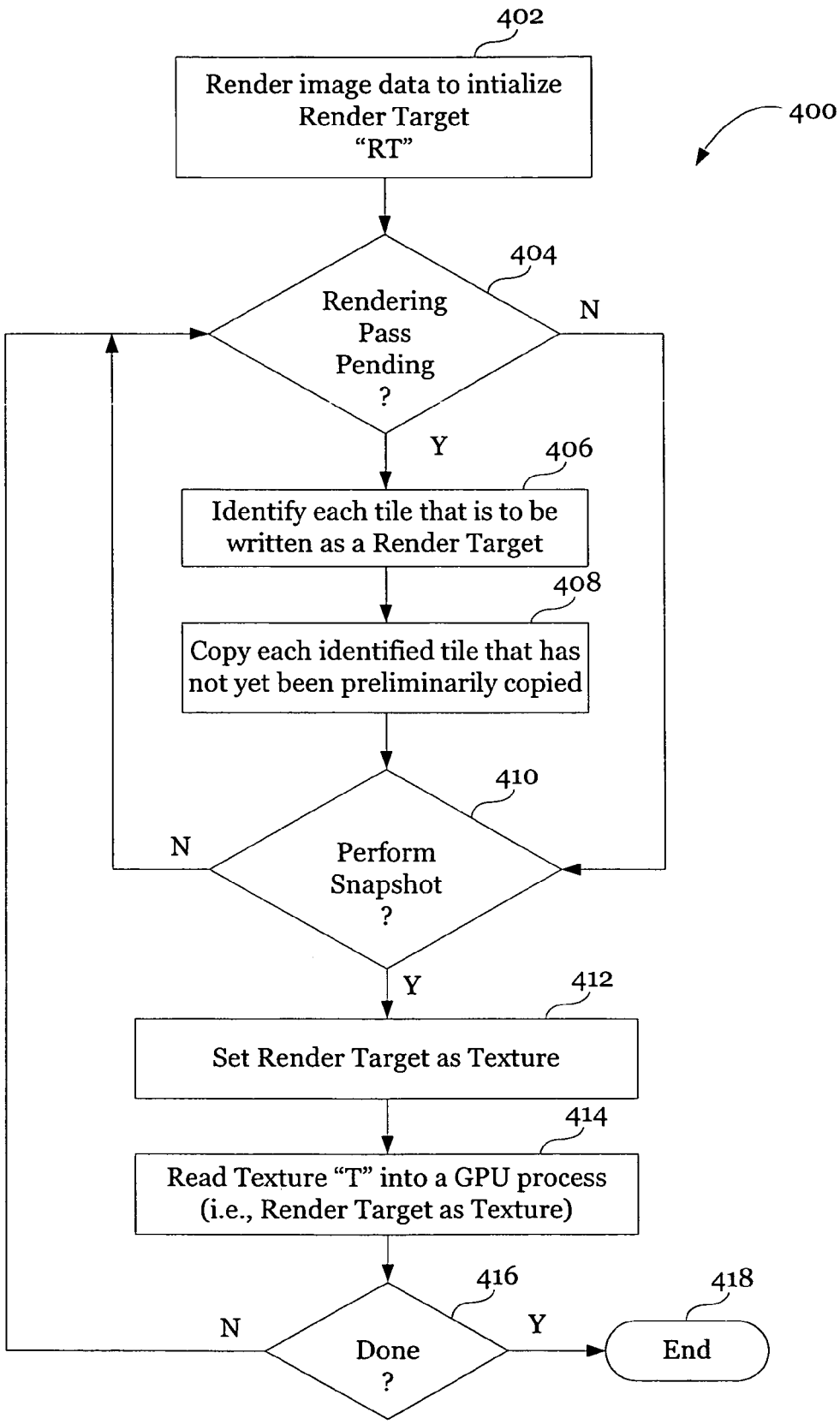
FIG. 4 is a flow diagram depicting an exemplary method for using a render target as texture, according to a specific embodiment of the present invention.

FIG. 4 is a flow diagram 400 depicting an exemplary method for a specific embodiment of the present invention. At 402, a first bank of graphics memory (e.g., Bank[1] of FIG. 3) is initialized to include image data as a render target, such as image data 322*a* of FIG. 3 (before snapshot). Thereafter, each tile in that bank is designated as a target, or a destination, for writing (i.e., rendering) later-generated image data. In some embodiments, image data that is stored as the render target is not available as a texture until a snapshot is performed.

At 404, a determination is made as to whether a rendering pass is pending during which at least one tile is selected to be written. If a rendering pass is not pending, flow 400 continues to 410. But when a rendering pass is pending, flow 400 continues to block 406. At 406, each tile that is selected to be written with data representing the render target is identified. Once identified, the image data that was to be written into each tile of the first bank is instead written (i.e., preliminarily copied) into a tile in a second bank at 408, so long as each of these tiles has yet to be written before a snapshot is performed at 410. By writing the render target of each tile to the second bank, the tile containing image data representing the original render target remains to be used as texture, if desired. An example of image data written into the second bank as a render target is image data 324*b* of FIG. 3. Flow 400 continues next to 410.

At 410, a determination is made as to whether a snapshot is pending. If not, then flow 400 continues back to 404. But if a snapshot is pending, then flow 400 continues to block 412. At 412, the tiles constituting the render target are then designated as texture, too. In some cases, this can be implemented by indicating to a GPU that tiles written to the second bank as image data for the render target are, after the snapshot, to be considered both texture and render target. An example of image data written into the second bank as both texture and render target is image data 324*c* of FIG. 3. At 414, the tiles designated as texture are available as input into, for example, a shader or other GPU process to generate graphical images. In some instances, the tiles designated as texture continue to be available as texture until the next snapshot. Flow 400 continues back to 404 if at 416 a determination is made that the render target is still going to be used as texture, such as during a multipass algorithm. Otherwise, flow 400 can end at terminus 418.

Figure 5:
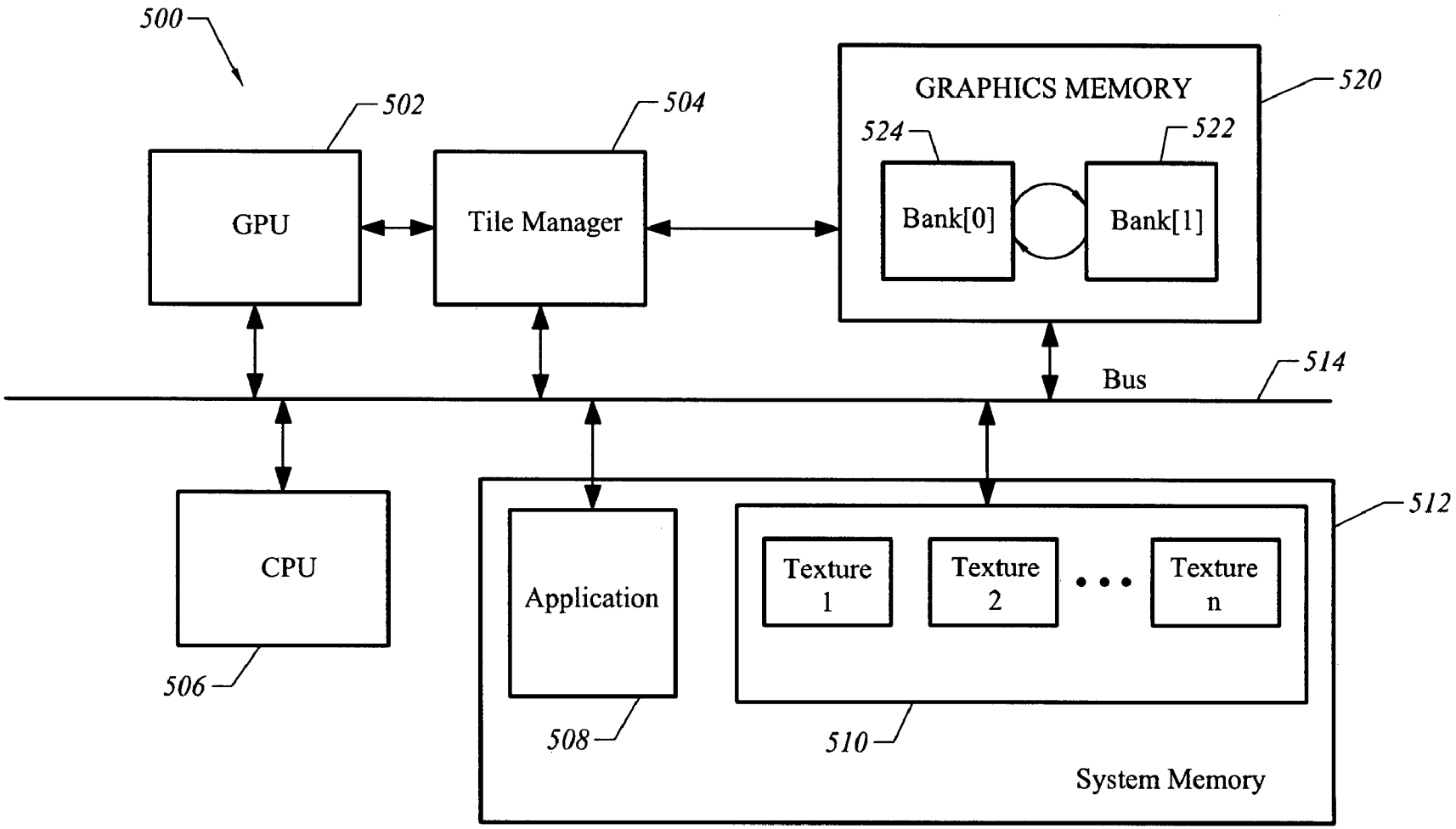
FIG. 5 is a block diagram of system suitable for generating graphical images based on a render target as texture in accordance with at least one embodiment of the present invention.

FIG. 5 is a block diagram of a system 500 suitable for implementing at least one embodiment of the present invention. System 500 includes a central processing unit ("CPU") 506 and a system memory 512, both communicating via a bus 514. System memory 512 contains a software application 508 that includes instructions for instructing CPU 506 and/or GPU 502 to generate graphical images at a visual output, such as a display device (not shown). One or more user input devices (not shown) can provide user input to system 500 via bus 514 and can cause software application 508 to initiate a method, in whole or in part, of any embodiment of the present invention. System memory 512 also includes any number of textures ("Texture 1," "Texture 2," . . . "Texture n") 510 for providing static texture maps.

System 500 also includes tile manager 504 coupled to GPU 502 and to graphics memory 520, which includes at least two banks ("Bank[0]") 524 and ("Bank[1]") 522. In operation, tile manager 504 governs which tiles of banks 524 and 522 will be rendered (i.e., written) as render target, and which tiles of banks 524 and 522 will be read as texture. Tile manager 504 contains logic and/or memory indicating, for each tile, where to locate both a memory location containing a render target, and another memory location containing a texture, if in a different location than the render target. In managing tile-by-tile writing and reading, tile manager includes memory, such as bit vectors, for bookkeeping purposes. Tile manager 504 uses these bit vectors to determine for each tile in which bank a render target and a texture resides. Tile manager 504 can also contain logic (as software, hardware, or a combination thereof) to initialize the bit vectors for implementing an incremental render target copy, as well as logic for performing a snapshot operation. The communication among GPU 502, tile manager 504 and graphics memory 520 (as well as other elements of FIG. 5) can be via bus 514, or can be via connections among each element. Although tile manager 504 is shown as an element separate than GPU 502 in FIG. 5, the structure and functionality of tile manager 504 can be distributed among one or more elements of FIG. 5, or alternatively, can be embodied in GPU 502 or any other element.

Each of render target 222 and texture 224 of FIG. 2 can be implemented as a two-dimensional array of tiles, with each array having a number of "N" tiles. Graphics memory 520 can store the tiles of each of render target 222 and texture 224 entirely in one bank, such as Bank[1] 522, or in a combination of any number of banks, such as banks 524 and 522. A tile represents a grouping of one or more units of image data, such as one or more pixels, that with the other tiles constitutes a displayable computer-generated scene (e.g., on display monitor, such as a liquid crystal display). Also, each tile is uniquely identifiable by both its position in an array (e.g., an associated number, such as 0, 1, 2, . . . , i, . . . , N) and the array to which it belongs (e.g., R 222 or T 224), where "i" is a specific position that is common across all banks. Further, each tile is stored in a memory location having an address, where the tile address can be identified by one or more pointers indicating whether that tile includes either texture or a render target, or both.

Graphics memory 520 need not be limited to two banks, but rather can include any number of banks for implementing a render target as a texture, according to the present invention. In some embodiments, graphics memory 520 can be a frame buffer. In some instances, bank 522 is configured as a front buffer, and bank 524 is configured as a back buffer, both of which constitute a double-buffer implementation of memory. In some embodiments, application 508 can be composed of instructions in OpenGL®, where an exemplary command for implementing a snapshot is "glCopyPixels," according to a specific embodiment.

According to at least one embodiment, tile manager 504 implements an addressing scheme for managing memory storing image data as render target or texture. In an exemplary addressing scheme, any tile, "t," can be identified by:

$$t=\text{Tile}([b],[i]), \qquad \text{Equation 1}$$

where "b" represents the bank in which the tile resides, and "i" is the specific position. For example, a tile identified as Tile ([1],[456]) indicates that the 456th tile in bank ("Bank [1]") 522 will either be written as a render target or read as a texture. The bank to which "b" points depends on whether a texture read of a render target write is pending in relation to that tile i. An exemplary method for determining which bank is accessed is discussed next.

Figure 6:
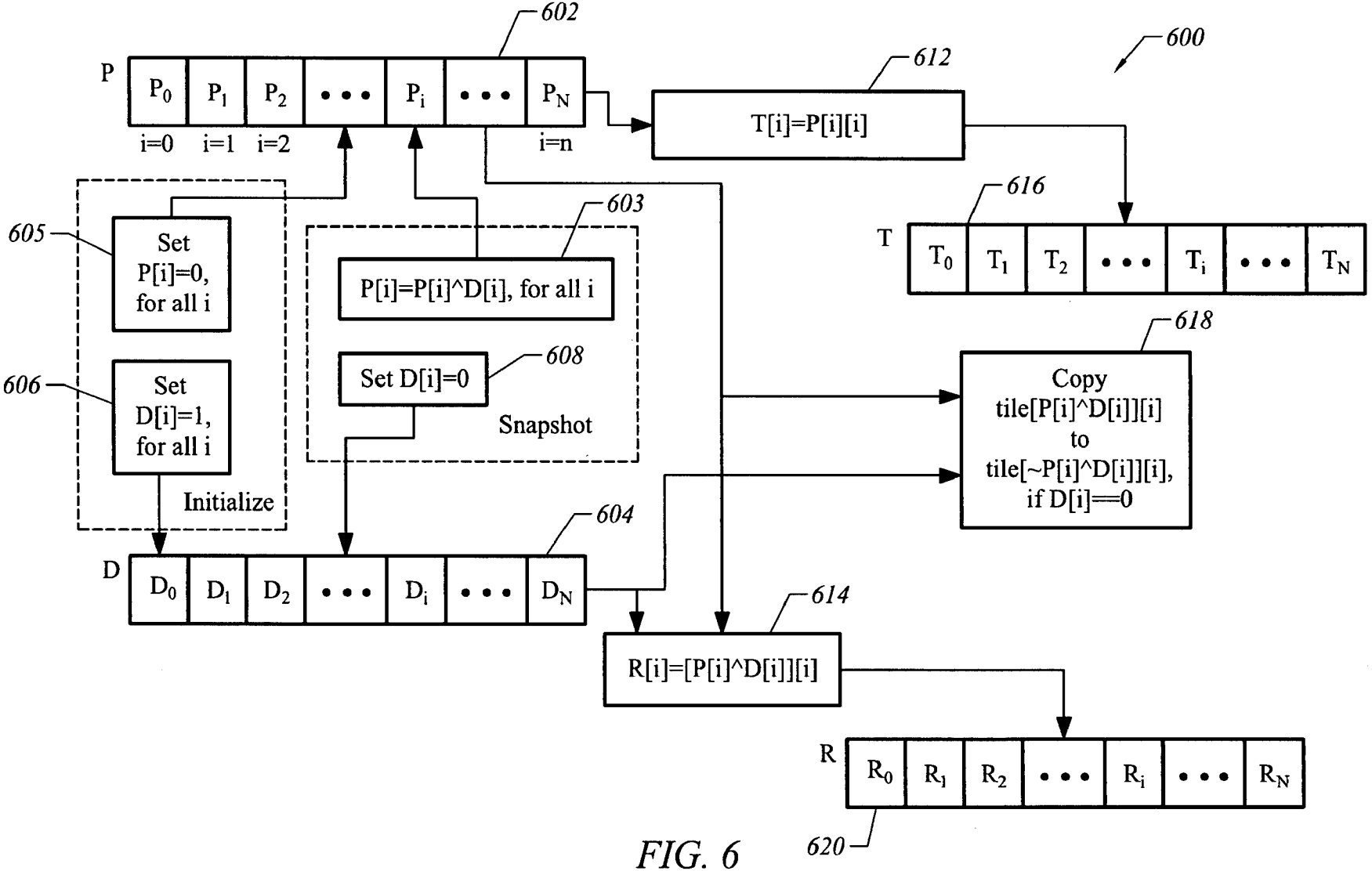
FIG. 6 is a functional block diagram of an exemplary tile manager, according to one embodiment of the present invention.

FIG. 6 is a functional block diagram of an exemplary tile manager 600, according to at least one embodiment of the present invention. In this example, tile manager 600 includes at least two bit vectors used for bookkeeping purposes (to sort out which bank contains image data for the render target and texture). These two bit vectors are: polarity bit vector ("P") 602 and dirty bit vector ("D") 604, each containing at least one bit for describing each tile i (e.g., tile 0, where i=0). Polarity bit vector 602 stores N bits for identifying which bank is associated with a write or a read access for a specific tile i. And dirty bit vector 604 stores N bits for identifying whether a specific tile i has been subject to a previous write access, especially during an interval where a snapshot is yet to occur.

Tile manager 504 of FIG. 5 applies these bit vectors when determining which bank is to be accessed with performing either a render target write or a texture read. When a texture read operation is pending, GPU 502 instructs tile manager 504 to select the bank from which to read the texture for a particular tile i. In response, tile manager 504 applies the following expression 612 to determine where to access the texture:

$$T[i]=(P[i],[i]), \qquad \text{Equation 2}$$

where "T" is the texture for tile "i." The bank in which the tile resides is determined from the polarity bit, P[i], of bit vector 602. For example, consider that a GPU requests the texture for the $3^{rd}$ tile, where bit 3 of P 602 is "1." The expression P[i],[i], yields T[i]=(1,3) and thus, the tile manager will access bank one, tile 3 to obtain the requested texture. Optionally, tile manager 600 can predetermined and store these values in a texture bit vector ("T") 616, where each bit represents the results obtained by Equation 2.

Once a GPU instructs tile manager 504 to use a render target as texture, tile manager 504 initializes its bookkeeping bit vectors. As shown in FIG. 6, logic 605 sets each polarity bit, P[i], of P 602 to zero, and logic 606 sets each dirty bit, D[i], of D 604 to one. But when the GPU requests that the tile manager perform a snapshot operation, then logic 603 replaces each polarity bit, P[i], of P 602 with the result of XOR-ing the polarity bit and the dirty bit for each tile i, and logic 608 sets each dirty bit, D[i], of D vector 604 to zero.

When rendering to a render target, the bank to which the GPU writes depends, at least in part, on whether the one or more target memory locations have or have not been written since the last snapshot. First, consider that the target has yet to be written. When the GPU instructs tile manager 504 to write a render target into a particular tile i, logic 605 of tile manager 504 does so by writing (i.e., copying) image data from the present render target (i.e., the present bank) into the render target in the bank defined by the expression "~P[i]^D[i]," so long as the dirty bit for this tile has a value of zero. Because the dirty bit indicates whether a specific tile has been previously written, a value of zero specifies that the tile has not been written with updated image data as a render target, whereas a value of one means that the tile has already been subject to a render target write during an interval when no snapshot has occurred.

Second, consider when a render target write operation is pending after a previous write to the subject tile before performance of a snapshot operation. In this case, GPU 502 instructs tile manager 504 to select the bank to which image data will be written as a render target for a specific tile i. In response, tile manager 504 applies the following expression 614 to determine where to write the render target:

$$R[i]=(P[i]\hat{}D[i],[i]), \qquad \text{Equation 3}$$

Where "R" is the render target for tile "i." The bank in which the tile resides is determined from the polarity bit, P[i], of bit vector 602 XOR'ed with the corresponding dirty bit, D[i], of bit vector 604, where the symbol "^" indicates an exclusive-OR logical operation. For example, consider that a GPU requests to write image data into render target at the $19^{th}$ tile, where bit 19 of P 602 is "1" and bit 19 of D 604 is "1." The expression P[i]^D[i], [i] yields R[i]=(0,19), and hence, the tile manager will write the render target access to tile 19 of bank zero. Optionally, tile manager 600 can predetermine and store these values in a render target bit vector ("R") 620, where each bit represents the results obtained by Equation 3. Lastly, the significance of the functionalities performed by tile manager 600, such as performed by logic 618, is discussed further in connection with FIGS. 7 to 10C, all of which illustrate exemplary functionality of tile manager 504 of FIG. 5, according to various embodiments of the present invention.

Figure 7:
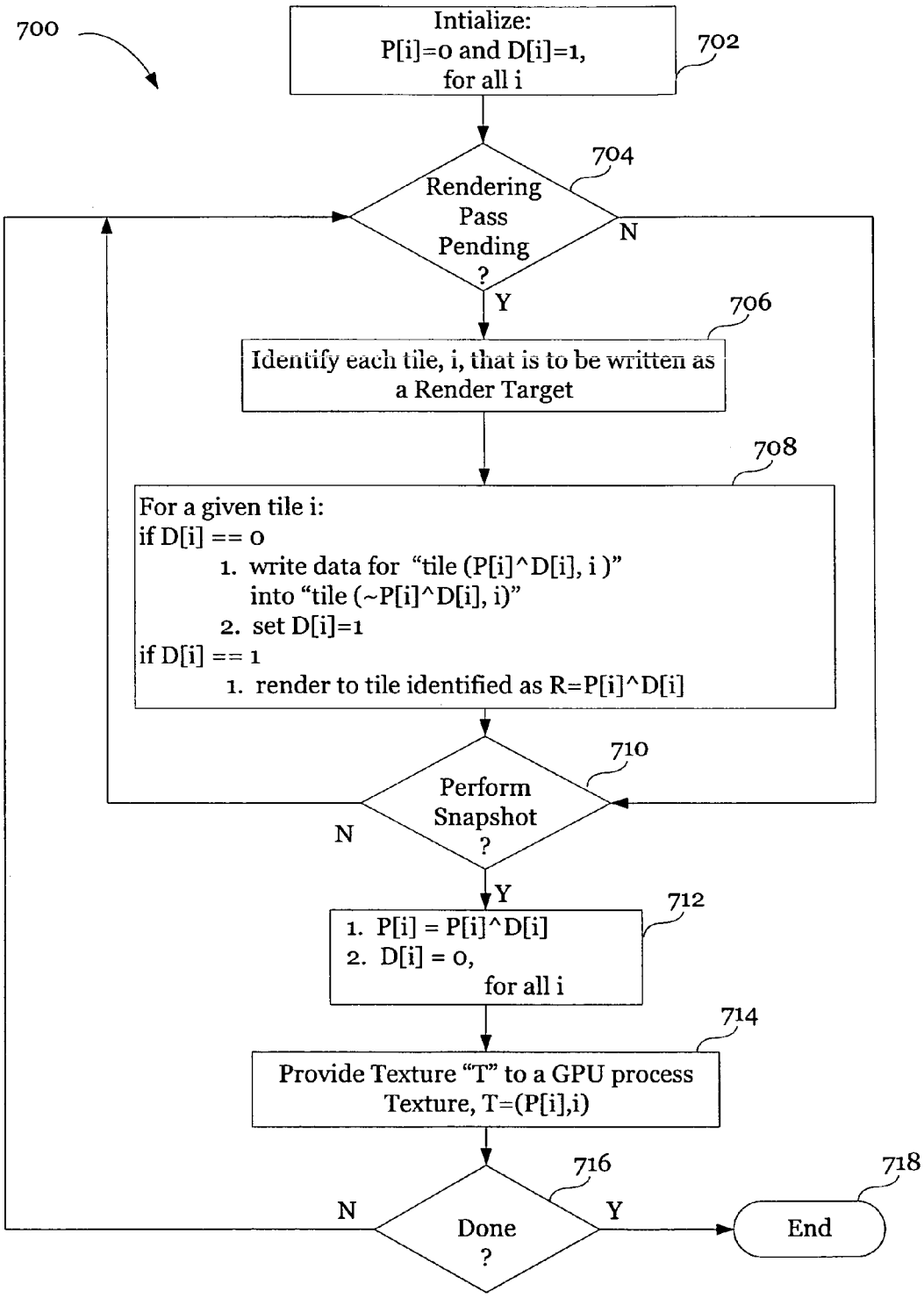
FIG. 7 is a flow diagram that describes the functionality of an exemplary tile manager, in whole or in part, according to a specific embodiment of the present invention.

FIG. 7 is an exemplary flow diagram that describes the functionality of tile manager 600, in whole or in part, according to a specific embodiment of the present invention. FIGS. 8A to 10C illustrate specific instances of implementing tile manager 600 of FIG. 6 to manage the render target as texture, as described by flow 700 of FIG. 7.

Figure 8A:
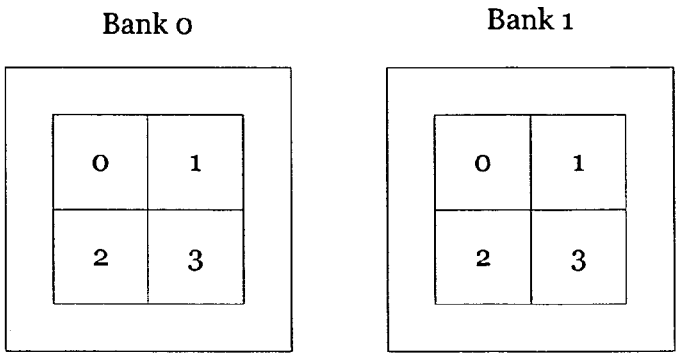
FIGS. 8A to 8C, 9A to 9C, and 10A to 10C illustrate specific examples of implementing a tile manager to govern the use of a render target as texture in accordance with various embodiments of the present invention.

FIG. 8A depicts two banks, "Bank 0" and "Bank 1," both of which contain four tiles. Although these banks can contain any number of tiles, the following discussion limits the number of tiles to simplify the depiction of using various render target tiles as texture tiles. As shown in FIG. 8A, both banks are empty; they contain neither texture or render target ("RT") image data. The states of these banks are typical when flow 700 is yet to commence. But as the legend indicates in FIG. 8A, any of the eight tiles can contain either texture or render target image data, or both, or neither.

Figure 8B:
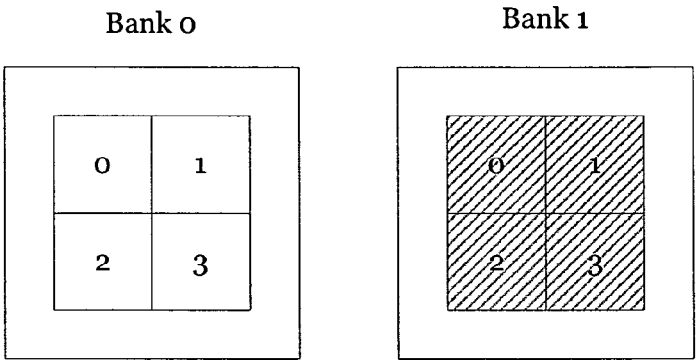

At 702 of FIG. 7, the render target is initialized, which typically occurs with a first rendering to a memory target. For example, consider that a rasterizer operation of GPU 502 of FIG. 5 seeks to write image data in all or some of the tiles constituting a render target. Here, each polarity bit and each dirty bit are respectively set zero and one. Initial to flow 700, GPU 502 will write image data as defined by expression 614 of FIG. 6. Consequently, each tile of bank 1 will be written as the render target, R, the location of which is determined by the result of XOR-ing each respective polarity and dirty bit (e.g., [P[i]=0]^[D[i]=1], or [[0]^[1]], which is equivalent to 1). FIG. 8B depicts this initialization of the render target. That is, each polarity bit of the bit vector P is 0, whereas each dirty bit of the bit vector D is 1. The render target is defined as those tiles located by XOR-ing polarity bits with dirty bits, the result of which can be deposited in the render target ("RT") bit vector (e.g., R 620 of FIG. 6). In this instance, the RT bit vector is entirely populated by values of one. If GPU 502 should require image data to be written to a tile, tile manage 504 will consult the RT bit vector to determine which bank (for a specific tile) will be written to. Note that at this point in flow 700, image data is yet not available for use as texture.

At 704, tile manager 504 of FIG. 5 determines whether a rendering pass is pending by receiving an indication from, for example, GPU 502. If tile manager 504 receives an indication of a pending rendering pass, flow 700 continues to 706. But if no rendering pass is pending, tile manager 504 is not required to manage the writing of image data into the render target, and thus, flow 700 continues to 710. At 710, tile manager 504 determines whether it has been instructed by GPU 502 to effectuate a snapshot operation. If not, then flow 700 continues back to 704. But if a snapshot is requested, then tile manager 504 performs that operation at 712. Here, tile manager 504 modifies polarity bits and dirty bits as determined by logic 603 and 608 of FIG. 6. In particular, tile manager 600 replaces each polarity bit with a previous value of each polarity bit XORed with a respective dirty bit, and then sets all dirty bits to a value of zero.

Figure 8C:
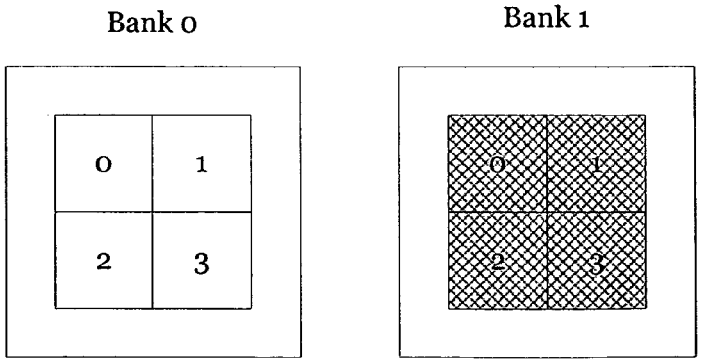

Further to the example, FIG. 8C illustrates the states of Banks 0 and 1 after the snapshot. As shown, each tile of Bank 1 can be a target for rendering image data as well as texture. Note that the texture ("T") bit vector of FIG. 8C, which can be similar to texture bit vector ("T") 616 of FIG. 6, has each of its bits set to 1. Consequently, graphics memory 520 now includes texture for input back into GPU 502, whereby the texture is available for reading at 714 of FIG. 7. To read texture, GPU 502 generally provides to tile manager 504 the identities of the tiles subject to a texture read operation. With the identity of each texture tile known (e.g., identifiers such as i), tile manager 504 uses the identifiers to access the appropriate banks from which to read texture using expression 612. That is, tile manager 504 governs the reading back of texture by reading each tile i from the banks identified by the relevant polarity bits P[i]. As such, each texture tile shown in FIG. 8C is located in Bank 1. In some embodiments, the tile manager can effectuate the reading of texture at other points of flow 700 other than at 714 (not shown).

Figure 9A:
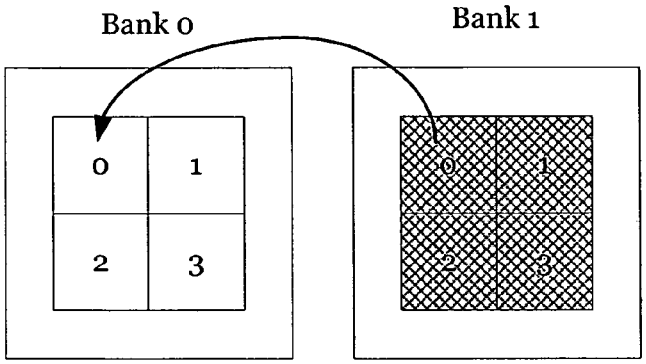

Next, flow 700 continues to 716. If tile manager 504 determines that the render target is no longer needed as texture (e.g., a multipass algorithm has terminated), then flow 700 ends at 718. But if the render target still is used as texture, then flow 700 returns to 704. Further to the example of the two banks of four tiles, consider that a rendering pass is identified as pending (or has been requested) at 704. This means that at least one tile of the render target is selected to be written, and as such, flow 700 moves to 706. At 706, tile manager 504 identifies each tile i to be written. FIG. 9A illustrates the tile selected to be written is tile [0], where i=0. After identifying which tiles will be written as render target, then flow 700 continues to 708. To determine which bank will be written, tile manager 504 tests the dirty bit associated with tile [0]. As the associated dirty bit, D[0], is zero, tile manager 504 will write data representing a render target into Bank 0 (e.g., Bank[0][0]) rather than Bank 1 (e.g., Bank[1][0]). Then, the associated dirty bit is set to 1, which indicates that tile [0] has been copied to another bank.

Figure 9B:
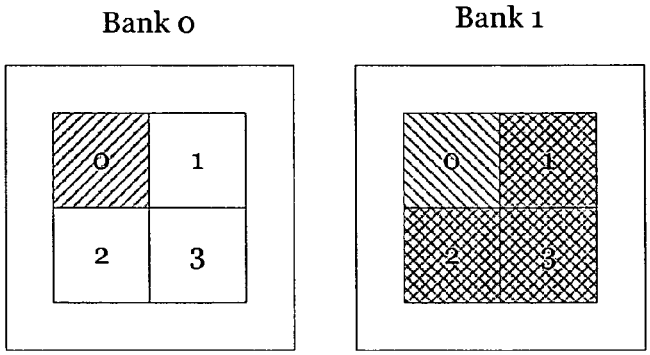

But note that after the dirty bit associated with a tile has been set to 1 (because that tile has been written with data representing an updated render target), then the next time that same tile is subsequently identified as a tile to again be written (without any intervening snapshot operation), the tile will not be again copied. Rather, at 708, the tile receiving the copy of the original tile will be the subsequent target for writing image data. For example, consider that FIG. 9B depicts the contents of Banks 0 and 1 after the render target has been updated at 708 of FIG. 7. As shown, tile manager 504 has modified the dirty bit vector, D, to include a value of 1 for D[0]. Although each bit of texture bit vector, T, still points to the tiles of Bank 1 from which to read texture, the render target bit vector, RT, now specifies that tile [0] of Bank 0 is the target tile to which later renderings will be written. As such, no copying occurs for subsequent renderings to tile [0]; that is, the image data constituting a render target will be written directly into a tile identified at 708 by R=[P[i]]^[D[i]]. In this case, subsequent renderings to tile [0] will be written to tile [0] of Bank 0, since [P[i]=1]^[D[i]=1], or [[1]^[[1]], which is equivalent to "0." Further renderings to tile [0] will likewise be written to that same tile in Bank 0. Consequently, FIG. 9B shows that tiles [2], [3], and [4] of Bank 1 serves as both render target and texture, whereas the texture and render target of tile [0] are located in different banks (e.g., different memory locations). After this update to the render target, flow 700 continues to 710.

Figure 9C:
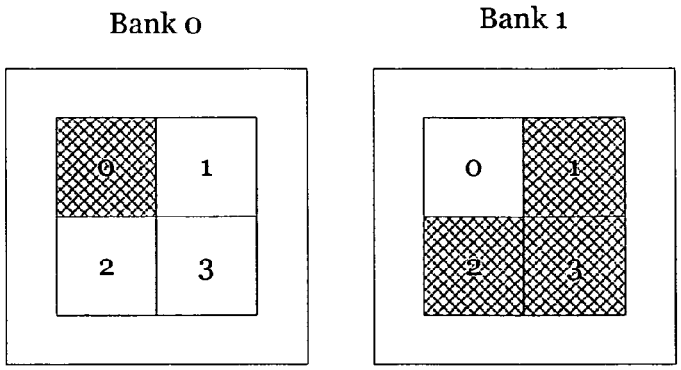

At 710, consider that GPU 502 requests another snapshot. Again, tile manager 504 can modify the one or more bits (e.g., operating as pointers) of the polarity and dirty bit vectors as determined by logic 603 and 608 of FIG. 6. Notably, the polarity bit for tile [0], which is associated with a tile that was recently rendered to in FIG. 9A, now points to Bank 0. This means that the texture of tile [0] now can be found in Bank 0, along with the render target image data, as is shown in FIG. 9C. Generally, a snapshot readjusts the texture of a tile to the bank containing the render target written last. Flow 700 then continues to 714 and to 704 in a fashion similar to that described above.

Figure 10A:
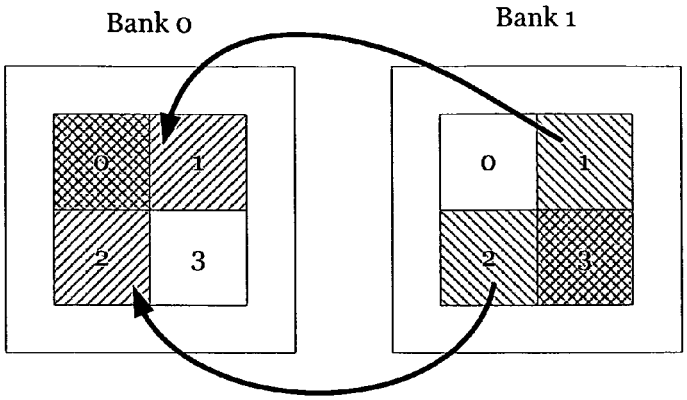

Next, at 704, consider that GPU 502 selects tiles [1] and [2] of bank 1 to write as render target image data. Tile manger 504 identifies those tiles at 704 and copies them from Bank 1 to Bank 0 at 708, as determined by logic 618 of FIG. 6. FIG. 10A depicts the states of the texture and the render target after 708. As shown, the texture for tiles[1] and [2] still reside in Bank 1, but the render target is located in Bank [0]. Regarding the dirty bit vector bits D[1] and D[2], tile manager 504 sets them to a value of one. And the RT vector bits now reflect that tiles [1], [2] and [3] of Bank 0 contains the render target, whereas the texture for tile [4] is located in Bank 1.

Figure 10B:
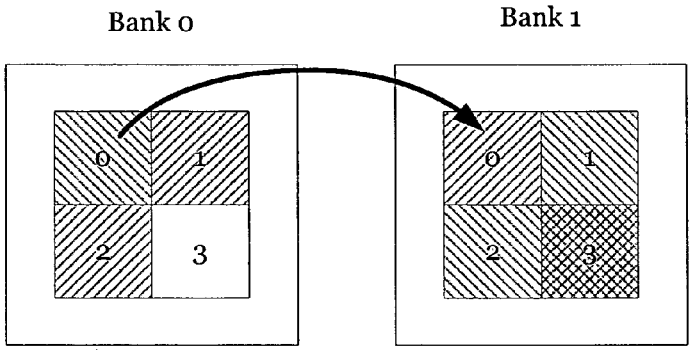
Figure 10C:
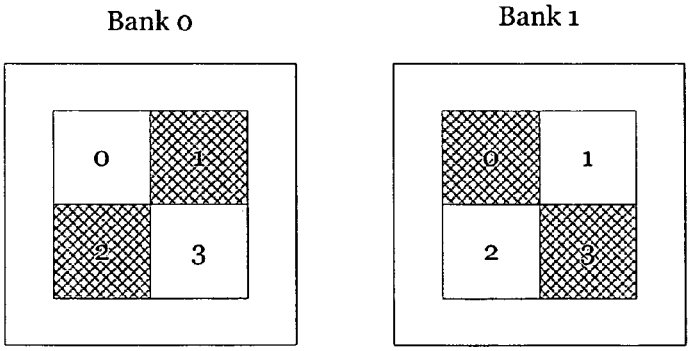

FIG. 10B depicts the states of the texture and the render target at 708 after yet another rendering pass. In this case, logic 618 of FIG. 6 causes a portion of the render target to be copied into tile [0] of Bank 1, followed by updates to both the dirty bit vector (e.g., D=1110) and the RT bit vector (e.g., RT=1001). FIG. 10C shows the result of yet another snapshot performed at 710 of FIG. 7 involving both the render target and texture of FIG. 10B. Tile manager 504 can perform this snapshot similar to other snapshots described above. Interestingly, tiles [1] and [2] of Bank 0 and tiles [0] and [3] of Bank 1 each contain image data representing both the texture and the render target.

The various methods of using a render target for use as texture, as described above, can be governed by software processes, and thereby can be implemented as part of an algorithm (e.g., a multipass algorithm) governing the access of tiles (e.g., by managing access to memory locations) containing data representing either texture or a render target, or both.

An embodiment of the present invention relates to a computer storage product with a computer-readable medium having computer code thereon for performing various computer-implemented operations. The media and computer code may be those specially designed and constructed for the purposes of the present invention, or they may be of the kind well known and available to those having skill in the computer software arts. Examples of computer-readable media include, but are not limited to: magnetic media such as hard disks, floppy disks, and magnetic tape; optical media such as CD-ROMs and holographic devices; magneto-optical media such as floptical disks; and hardware devices that are specially configured to store and execute program code, such as application-specific integrated circuits ("ASICs"), programmable logic devices ("PLDs") and ROM and RAM devices. Examples of computer code include machine code, such as produced by a compiler, and files containing higher-level code that are executed by a computer using an interpreter. For example, an embodiment of the invention may be implemented using Java, C++, or other object-oriented programming language and development tools. Another embodiment of the invention may be implemented in hardwired circuitry in place of, or in combination with, machine-executable software instructions.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. A method of generating graphical images comprising:

detecting an update to image data representing a portion of a render target, the render target stored in a first memory location coupled to a graphics processing unit;

in response to detecting said update, generating a snapshot of said render target by forming a pointer-based copy of said portion of said render target, designating said copy to be used as a texture;

designating said copy as a recipient of a subsequent update when said portion of said render target is selected to receive said subsequent update; and storing said copy designated to be used as a texture in a second memory location coupled to the graphics processing unit, wherein image data is converted into textures and said graphics processing unit is operable to render image data to the render target in said first memory location without invoking a lock-out when a read access of texture in said second memory location is pending, the first memory location and the second memory location managed as separate writing and reading memory locations so the graphics processing unit writes render targets to the first memory location and reads textures from the second memory location.

2. The method of claim 1 wherein said generating a snapshot comprises forming a pointer-based copy of said render target at a coarse level of resolution.

3. The method of claim 1, wherein said generating a snapshot comprises forming a pointer-based copy of a subset of the render target.

4. The method of claim 1 further comprising:

wherein a render target pointer and a texture pointer are each configured to indicate either said first or said second memory locations.

5. The method of claim 4 further comprising swapping said render target pointer from indicating said first memory location to indicating said second memory location.

6. The method of claim 5 wherein said designating said copy as texture further comprises swapping said texture pointer from indicating said first memory location to indicating said second memory location during the performance of said snapshot operation.

7. The method of claim 1 further comprising:

storing data representing another portion of said render target in a third memory location; designating data representing said another portion as texture such that another texture pointer indicates said third memory location.

8. A method of generating textures for graphics processing, comprising:

storing image data in a render target in a first memory location coupled to a graphics processing unit;

generating a snapshot that is a pointer-based copy of at least a portion of image data in said render target at a particular instance of time;

designating the snapshot as a texture; and storing said snapshot designated as a texture in a second memory location coupled to the graphics processing unit, the first memory location and the second memory location managed as separate writing and reading memory locations so the graphics processing unit writes render targets to the first memory location and reads textures from the second memory location.

9. The method of claim 8, wherein said generating a snapshot comprises forming a pointer-based copy of said render target at a coarse level of resolution.

10. The method of claim 8, wherein said generating a snapshot comprises forming a pointer-based copy of a subset of the render target.

* * * * *